United States Patent [19]

Van Zantwyk

[11] 4,124,875

[45] Nov. 7, 1978

[54] ELECTROSTATIC DRY DUSTING APPLICATOR

[75] Inventor: A. Conrad G. Van Zantwyk, Closter, N.J.

[73] Assignee: Oxy Dry International, Inc., Roselle, N.J.

[21] Appl. No.: 739,556

[22] Filed: Nov. 8, 1976

Related U.S. Application Data

[63] Continuation of Ser. No. 520,717, Nov. 4, 1974, abandoned, which is a continuation of Ser. No. 299,274, Oct. 20, 1972, abandoned.

[51] Int. Cl.[2] ..... B05B 5/04

[52] U.S. Cl. ..... 361/227; 222/352

[58] Field of Search ..... 361/213, 226, 227; 222/231, 282, 285, 352, 414

[56] References Cited

U.S. PATENT DOCUMENTS

| | | | |
|---|---|---|---|
| 254,957 | 3/1882 | Grow | 222/352 X |
| 3,070,264 | 12/1962 | Christy | 222/352 X |
| 3,680,779 | 8/1972 | Reilly | 361/226 |

*Primary Examiner*—Harry E. Moose, Jr.
*Attorney, Agent, or Firm*—Leydig, Voit, Osann, Mayer & Holt, Ltd.

[57] ABSTRACT

A dry dusting applicator for laying down a powder profile of starch, wax, or the like onto a substrate which comprises a receptacle for holding the powder to be dispensed which has an open bottom, a dispensing roll set in the open bottom and capable of picking up powder as it rotates in the receptacle and a brush means functioning to meter powder from the dispensing roll as well as otherwise preventing powder egress from the receptacle. In a preferred embodiment, at least one high voltage discharge wire charged to provide the desired electrostatic field is included and is positioned relative to the brush so that powder does not build up within.

9 Claims, 6 Drawing Figures

ELECTROSTATIC DRY DUSTING APPLICATOR

This is a continuation of application Ser. No. 520,717, filed Nov. 4, 1974 now abandoned which in turn is a continuation of application Ser. No. 299,274 filed Oct. 20, 1972 now abandoned.

DESCRIPTION OF THE INVENTION

This invention is directed to a sprayer for laying down a powder profile on a surface, and, more particularly, to a dry dusting applicator which may be especially advantageously employed in connection with applying wax powder.

To prevent, for example, the offsetting of ink from a freshly printed sheet onto the back of a subsequent sheet and to eliminate blocking in the processing of synthetic film or rubber sheeting, a wide variety of various materials have been used. Thus, commercially, materials such as hydrogenated caster oil, starch and the like have been employed, often as a mixture with a minor amount of a free flowing agent. Various waxes have also been used either alone or as mixtures with starch or other powders when it is desired to, for example, provide a glossy surface to the substrate being coated.

The powder profile is conventionally applied to the substrate being coated by either an electrostatic or a pneumatic sprayer. Typically, an electrostatic sprayer generally comprises a powder receptacle with a dispensing roller and associated wiping blades, the latter forming a metering function. As the roller rotates in the powder receptacle, powder particles adhere to the roller surface; and the powder then exits from the receptacle at a substantially uniform rate by being metered out of the dispenser by the wiping blades. An electrostatic discharge tube is positioned beneath each of the wiping blades; and, by the "corona" effect, the air molecules in the vicinity of these tubes become ionized. In turn, the powder particles, having been stripped from the roller by the electrostatic field, are also ionized. The ionized particles having the same polarity as that appearing in the surface of the discharge tube are directed away from such tubes and fall towards the surface being coated.

When it is desired to spray a wax powder, it is generally necessary to prevent the wiping blades from actual physical contact with the dispensing roller since contact readily deforms the wax particles carried by the dispensing roller and embeds them into the surface therof. Accordingly, when dispensing wax powder in an electrostatic sprayer, it is consequently necessary to set the wiping blades in perfect alignment with the roller, leaving only enough space for the powdered wax to pass between the blade and the roller. Maintenance of this proper adjustment requires a considerable degree of patience and skill on the part of the operator; and a lack of precision in the adjustment will generally result in unsatisfactory results, particularly where high quality performance is required.

Still furthr, some of the commercially used wax powders have a tendency to build up and later melt on the electronic tubes being used in the sprayer so as to require frequent cleaning, even during a single operational shift.

Because of the special considerations necessitated when wax powders are dispensed, commercially available electrostatic sprayers are typically designed for either dispensing wax powders or starch or the like, but not both.

It is accordingly an object of the present invention to provide a dry dusting applicator which is capable of dispensing wax, starch or other powder particles with substantially equivalent performance.

A further object lies in the provision of an applicator of the above type which provides accurate metering of the powder being dispensed. A related object provides a dry dusting applicator which achieves precision in the amount of powder being sprayed yet does not necessitate careful attention as to the setting of the metering means.

Yet another object is to provide a dry dusting applicator which is capable of laying down a wax powder profile without any significant tendency for the wax powder being sprayed to build up on the applicator.

Other objects and advantages may be seen from the accompanying drawings, in which.

While the invention is susceptible of various modifications and alternative forms, certain specific embodiments thereof have been illustrated and will be described in detail herein. It should be understood, however, that it is not intended to limit the invention to the particular forms disclosed but, on the contrary, the intention is to cover all modifications, equivalents and alternatives falling within the spirit and scope of the invention. For example, while the most advantageous embodiment of the present invention is directed to an electrostatic sprayer of the type illustrated, it should be appreciated that the invention is equally applicable to utilization in connection with any other type of sprayer. Similarly, while it is desirable to use thin flexible, insulated discharge wires rather than electronic tubes to develop the necessary electrostatic field since significant powder buildup is substantially obviated, the invention is, of course, equally applicable to the use of electronic tubes or any other means which may be charged to create the desired field.

In general, the dry dusting applicator of the present invention includes a receptacle for holding a quantity of a powder to be dispensed and having an open area, a dispensing roll positioned in the open area of the receptacle for picking up powder on its surface as it rotates in the receptacle and brush means functioning to meter the amount of powder carried by the dispensing roll surface as the roll is rotating to bring the powder to the open area of the receptacle for laying down a powder profile on a substrate. In a preferred embodiment, at least one high voltage wire discharge to electrostatically charge the powder particles, break up any agglomerated particles and blast the particles off the surface of the dispensing roll is provided. By the combination of these features, the dry dusting applicator is capable of laying down a powder profile of wax or other typically sprayed materials in a uniform fashion with superior performance.

Figure 1:
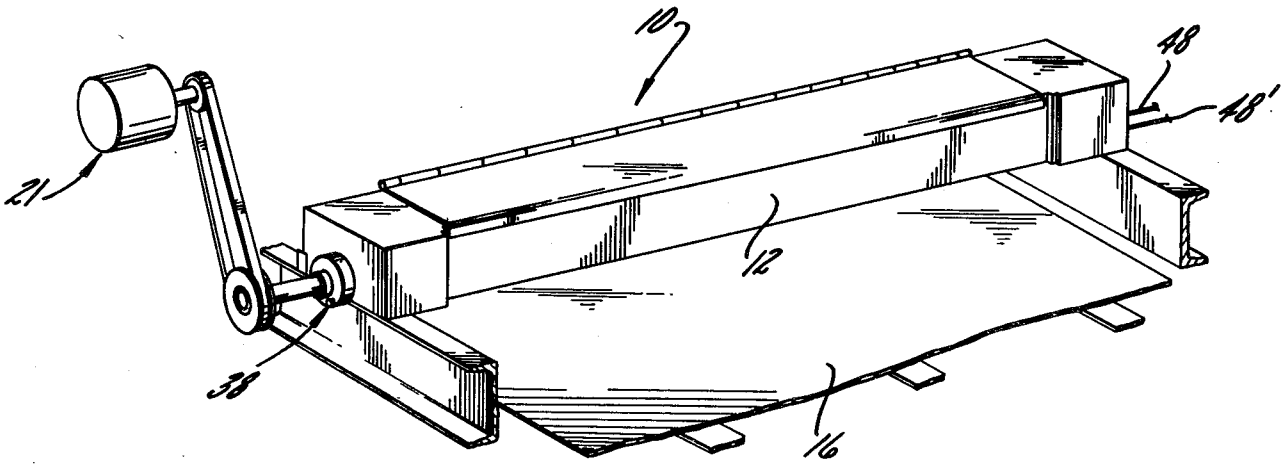
FIG. 1 is a perspective view and showing, in general, the positioning of the dry dusting applicator relative to the substrate being coated.

Turning now to the figures, there is shown in FIG. 1 an exemplary embodiment of the electrostatic dry dusting applicator of the present invention. Thus, as is shown, the dry dusting applicator, generally indicated at 10, includes a powder receptacle 12, retaining a particular powder 14 (FIG. 5) such as wax, starch or the like (typically having an average particle size of less than 100 microns) to be dispensed, to lay down a profile of powder onto a moving substrate, such as a freshly printed sheet 16 below the applicator. The receptacle 12 may be sized to accommodate any desired amount of powder and may be mounted by any appropriate support.

To remove the powder to be sprayed from the receptacle, there is provided a dispensing roll which picks up as it rotates within the receptacle and carries the powder on its surface. As is illustrated, a dispensing roll 18 is journaled in the receptacle 12 and is positioned adjacent the bottom open end shown generally by arrow 20 of the receptacle 12. The dispensing roll may be driven by any suitable mechanism such as a conventional drive motor indicated at 21 (FIG. 1), and the particular means used do not form a part of the present invention. Typically, the driving means will be geared so that the rotation of the roller can be varied within a selectively wide range. It should be appreciated that the speed of rotation can be coordinated with the amount of powder carried by the surface of the dispensing roller to provide the desired rate of powder laydown.

As is known in the sprayer field, a suitable dispensing roll can have a smooth surface. Alternatively, some commercially available electrostatic sprayers utilize a dispensing roll having a rough or uneven surface wherein the powder particles can be viewed as being carried in pockets or holes formed by the uneven surface. Rollers of this type can be made by any of several well known techniques, including, for example, sand blasting, chemical etching and machine engraving. Either smooth or rough surface dispensing rolls may be used with the present invention.

It is generally preferred, however, to employ a dispensing roll which has been machine engraved. This appears to aid in achieving a highly uniform powder profile on the substrate being coated. While an engraved surface obtained by conventional machine engraving is preferred for the dispensing roll, it should be understood that the term "engraved surface" is meant to include a rough surface having pockets or holes for carrying powder particles regardless of how the rough surface was obtained.

Figure 5:
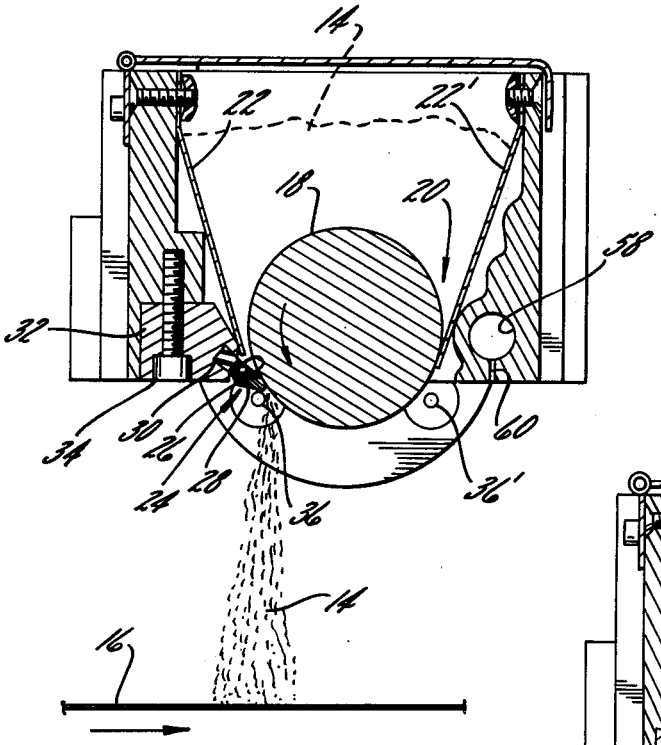
FIG. 5 is a further cross-sectional view, taken generally along line 5—5 of FIG. 2 and showing the positioning of the brush means in relation to the dispensing roller and the positioning of the flexible wire relative to the brush means.

As can best be seen from FIG. 5, when the dispensing roll 18 rotates within the powder receptacle, the surface picks up powder which is then carried as the roll rotates to the open end 20 of the receptacle. A pair of stainless steel blades 22, 22' may be desirably employed to form a tapered interior configuration within the receptacle to guide the powder toward the dispensing roll.

In accordance with one aspect of the present invention, there is provided a metering means for the powder which is capable of achieving a desired rate of dispensing without either causing buildup on the powder roll itself or requiring any precision setting. To this end, as is shown in FIG. 5, there is provided a brush 24 which contacts the surface of the dispensing roll 18 to control the amount of powder exiting from the receptacle as well as combining with the blade 22 to form a seal for preventing the powder within the receptacle from sifting out onto the substrate being coated. The blade 22, suitably made of, for example, stainless steel, is spaced away from the surface of the powder dispensing roller 18. There is no precision required as to the specific distance, but it will be appreciated that there will be an optimum setting.

With regard to the criteria necessary for the brush means used in accordance with the present invention, the number of bristles and the density of the brush should be such as to prevent any significant sifting of powder particles through the brush which would adversely affect the uniformity of the powder profile as well as the amount thereof. Also, the individual bristle used should combine strength, flexibility and resilience so as to be capable of riding in contact with the dispensing roll without any tendency to excessively bend without a substantial tendency to return to a relatively straight, unflexed condition. Stated another way, the bristle must have sufficient strength and flexibility to carry out the function of properly metering the amount of powder which can exit from the powder receptacle with the dispensing roller. It is also desirable to select a brush bristle with good wear properties. Additionally, the brush should be positioned relative to the dispensing roll so that contact sufficient to carry out the metering function is provided. This will perhaps vary widely, but it has been found satisfactory to maintain positioning such that about ¼ inch of the bristles are in contact with the surface of the dispensing roll.

In accordance with a still further aspect of the present invention, it is preferred to employ a tapered brush positioned so that the longer bristles contact the dispensing roll surface while the shorter bristles serve to support the longer bristles, preventing undesirable flexing. To this end, and as is shown in FIG. 5, the brush 24 is tapered with the longer bristles, generally indicated at 26 being in contact while the taper is sufficient so that the shorter bristles, indicated at 28, do not contact the dispensing roller surface but only serve to support the longer bristles. The employment of a tapered brush, positioned as shown in FIG. 5, also provides other significant advantages when the sprayer includes a means for electrostatically charging the powder particles. These will be described in detail hereinafter.

As a representative example of a suitable brush, the brush described in U.S. Pat. No. 3,395,042 to Herbert, Jr. has been found to be satisfactory. The individual bristles may be formed of nylon multifilaments, about 0.005 inch in diameter.

To allow for ready substitution or replacement of the brush means as due to excessive wear, the bristles of the brush 24 are firmly set in a cap 30 which is held in an insert 32 screwed, as shown at 34, into the wall of the powder receptacle 12. Accordingly, the brush 24 may be replaced by simply unscrewing the insert 32, pulling out the worn brush, sealing the new brush end cap in the insert 32 and screwing the insert 32 back into the powder receptacle wall.

Figure 2:
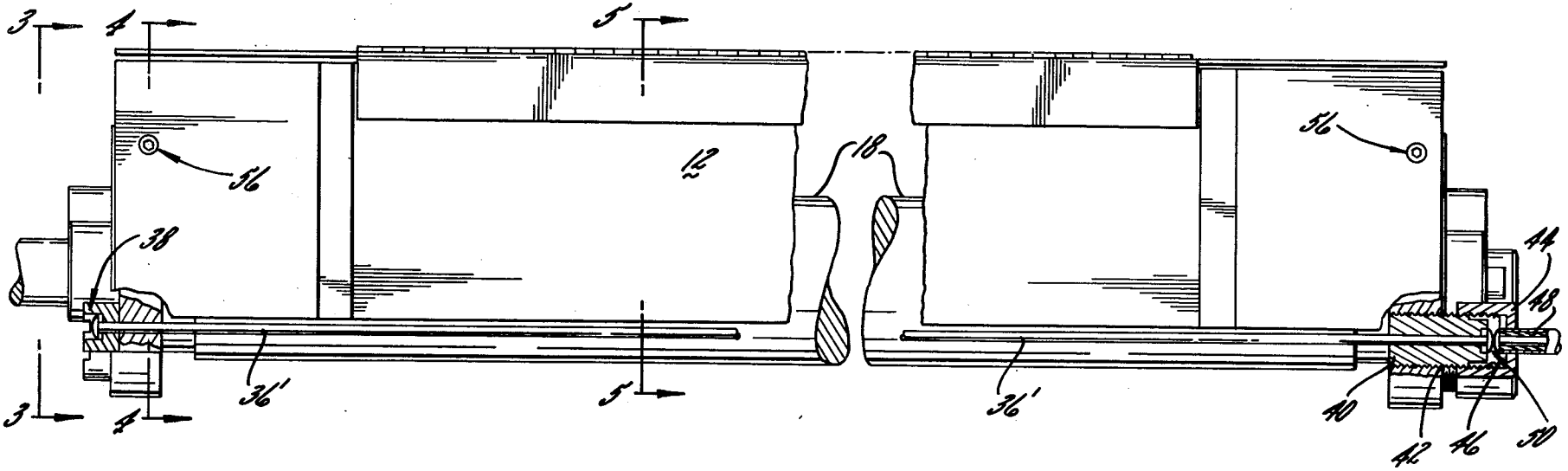
FIG. 2 is a front elevation view and is partly broken away to illustrate the mounting on the applicator of the flexible wire which provides the necessary electrostatic charge.

In accordance with yet another aspect of the present invention, there is provided a means for generating the requisite electrostatic field which comprises at least a single flexible high voltage discharge wire. The flexible wire serves to strip the wax or other powder from the engraved surface of the dispensing roll as it rotates into the open end of the container yet does not allow any significant buildup of wax or other powder on the wire, except perhaps only after extensive usage. Uniformity is also enhanced since the electrostatic charging tends to break up any agglomerated or loosely connected particles that are present on the dispensing roll surface. In the preferred embodiment, a pair of such flexible high voltage wires are employed. Thus, as is shown in FIGS. 1, 2 and 5, there are positioned below the dispensing roller 18 a pair of flexible high voltage wires 36, 36'. The wire 36 positioned closest to the brush 24 serves to blast the powder carried by roll 18 from the surface and down onto the substrate being coated.

In accordance with a still further feature of the present invention, the wire 36 is positioned with respect to the brush and the roller so that not only does the wire serve the stripping function but also prevents any buildup of powder on the brush itself. In other words, the wire provides a self-cleaning feature for the brush and does not allow any significant powder to collect between the bristles which could otherwise sift down onto the substrate being coated. If the positioning is improper, it is possible for the powder being dispensed to build up in the brush and then to sift down onto the substrate to cause nonuniformity in the powder profile and, for example, a streaky appearance.

In this connection, and as has been alluded to previously, the utilization of a tapered brush imparts significant advantages to the operation of the sprayer. Thus, the voltage level required to develop the necessary electrostatic field is dependent upon the distance between the discharge wire and the dispensing roll surface. A tapered brush configuration accordingly allows the discharge wires to be positioned closer to the dispensing roll surface than would be possible with a brush having a uniform thickness dimension. Also, when the discharge wire is positioned as shown in FIG. 5 in relation to the brush the tapered brush construction presents a thickness which allows the wire to maintain the brush bristles free of powder particles.

With certain powder materials, not all of the particles are stripped off and blasted away from the roll surface by wire 36, the second wire 36' positioned adjacent and below the wiping blade 22' serves to strip at least a significant part of any remaining portion from the roll so that, as in the case of a wax powder, embedment of a relatively permanent nature on the roll does not result when the surface of the roll contacts the wiping blade.

Suitably, the wires should be insulated and connected to a source which is capable of allowing operation of the wires at from about 8,000 to 10,000 volts. While operation outside this range could perhaps be used, this range has been found to be particularly advantageous. Suitable power sources are well known in the art. Similarly, any of the several known insulation materials such as, for example, polytetrafluoroethylene resin, may be employed to form the insulated coating for the wire.

In addition, the flexible wires should be suitably tensioned such that the wires remain taut and essentially parallel to the dispensing roller so that a substantially uniform electrostatic field is obtained. To this end, and as is shown in FIG. 2, one end of each of the wires (only wire 36' being, however, shown) is tightly affixed within an insulated housing generally shown at 38. The other end is provided with an insulated casing 40, threaded on its external surface as at 42. The casing 40 is maintained within an insulated end cap 44, also threaded as at 46. Tensioning and tightening of the flexible wire can be achieved by screwing the casing 40 into the end cap 44. As is also shown, the wire 36 is electrically connected to a high voltage source line 48 as generally indicated at 50.

Figure 3:
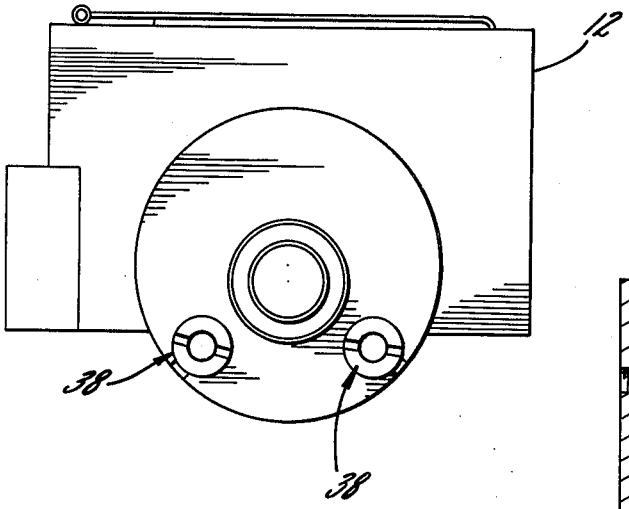
FIG. 3 is a cross-sectional view taken generally along line 3—3 of FIG. 2 and shows an exemplary means for allowing adjustment of the dispensing roll and the flexible wires in relation to the metering means of the illustrated embodiment of the applicator of the present invention which utilizes only a single brush.
Figure 4:
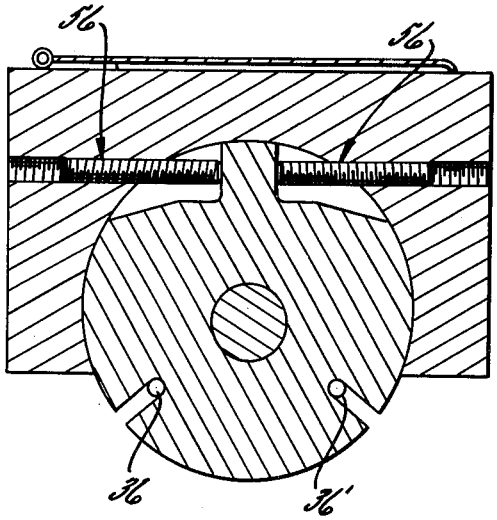
FIG. 4 is a cross-sectional view taken generally along line 4—4 of FIG. 2 and further illustrating the adjustment means shown in FIG. 3.

To provide a means for moving the wire relative to the brush, there is provided an adjustment means. As is shown in FIGS. 3 and 4, the wires 36, 36' are held in grooves 52, 52' fitted in blocks 54, 54' located in the ends of the casing of the powder receptacle 12. A screw adjustment as generally indicated at 56 is provided so that the position of the wires relative to the brush 24 may be varied to compensate for wear yet with the spatial positioning between the wire and the dispensing roller being maintained at a uniform setting. This latter constant spacing is necessary to provide the desired electrostatic field for blasting the powder off from the roll surface.

It should be appreciated that the adjustment means shown in FIGS. 3 and 4 is only an optional feature. No adjustment means need be provided; or, alternatively, any of a number of different modes could be utilized. For example, means could be employed, if desired, to allow individual adjustment of the discharge wires to the dispensing roll or to the brush. Further, to compensate for wear, the brush insert 32 can be readily made adjustable by providing slotted holes for the bolt 34 so that, as significant wear is perceived, the brush insert may be mounted in a position closer to the dispensing roll to regain the necessary contact between the brush bristles and the dispensing roll surface.

To further maintain the powder profile within the desired area, a pneumatic curtain may optionally and desirably be included. Thus, as is shown in FIG. 5, an air manifold 58 supplied by a source of air (not shown) is formed in the receptacle 12. A series of outlet holes 60 of, for example, about 1/16 inch in diameter are positioned across the manifold about ½ inch apart. In this fashion, air exiting from the manifold through the outlet holes forms an air curtain which minimizes interferences by the ambient conditions or the falling powder.

The amount of powder which can be effectively separated from the dispensing roller in the embodiment of FIGS. 1 through 5 can vary within wide limits. However, it should be appreciated that a point of saturation can result, the point of course differing for various powders. As this point nears, the system is incapable of separating all of the powder from the dispensing roll surface and a portion is carried back into the receptacle 12 as the surface passes the wiping blade 22'.

When materials such as wax powder are being dispensed, this causes the material to be forced into the engraved surface of the roller by the action of the wiping blade, resulting in an undesirable buildup on the roll. Moreover, this obviously affects the amount of powder which will be picked up by the next pass of the roll. This condition can cause a necessity for shutdown of the unit to clean the roll.

Figure 6:
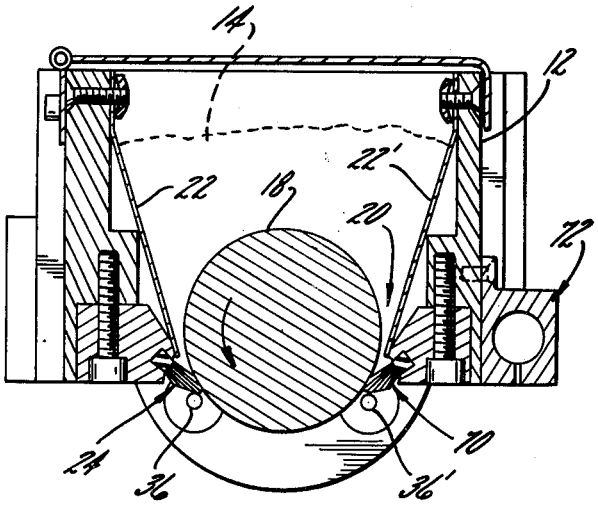
FIG. 6 is a cross-sectional view similar to FIG. 5, except illustrating an embodiment utilizing a pair of brush means.

Accordingly, one aspect of the present invention provides a dry dusting applicator capable of removing virtually all of the powder carried by the dispensing roll. To this end, and as is shown in FIG. 6, a dry dusting applicator is provided which includes first and second brush means. The elements of this embodiment which are common to the embodiment of FIGS. 1 through 5 have been given the same numerals for simplicity. Thus, as is shown in FIG. 6, the first brush means comprises a tapered brush 24 positioned on one side of the dispensing roll 18 while the second brush means 70 is positioned on the other side of the opening 20 of the receptacle 12. In this embodiment, the first brush means 24 serves the same functions as in the embodiment of FIGS. 1 through 5, with most of the powder being stripped from the surface by the wire 36. Again, the wire 36' serves to remove a still further portion of the powder; but, as has been pointed out, as the point of saturation is reached, the composite activity of both wires will not serve to get all the powder off the dispensing roll. The second brush means 70 accordingly functions not only as a seal for the receptacle 12 but also removes the remaining portions of powder from the engraved surface of the roll 18, which powder particles are then charged so as to be blasted towards the substrate being coated.

The positioning of the second brush means 70 relative to the dispensing roller 18 and the positioning of the wire 36 relative to the second brush means 70 are identical to that illustrated in the first initial embodiment described herein. Thus, it is the longer bristles of the brush which contact the roll surface with the shorter bristles supporting the longer bristles. Also, the wires are positioned relative to the brushes to maintain the brush bristles clean so as to avoid any powder buildup.

In addition to the ability to advantageously use the embodiment of FIG. 6 when the rate of powder being dispensed is relatively high, this embodiment is particularly versatile since the unit is symmetrical. This allows the dispensing roll to be rotated in either direction, as desired. Accordingly, while the air curtain generally indicated at 72 is positioned on the side, adjacent wire 36', the casting of the receptacle may be machined to provide for mounting on the other side, as when the roller is to be rotated opposite to the direction shown in FIG. 6.

It should be further appreciated that the embodiment of FIG. 6 provides a sprayer with sufficient versatility to accommodate such diverse particles as starch and wax and produce substantially equivalent and satisfactory results. More specifically, when using a dispensing roll having an engraved surface, it is necessary to use a coarser surface for laying down wax in a uniform profile than for starch particles. The sprayer shown in FIG. 6 including a double brush metering feature is capable of laying down a wax powder profile in a uniform fashion, without streaks, with a dispensing roll having a relatively fine engraved surface (viz. — 200 lines per lineal inch). This same roll can also readily spray starch particles in a uniform fashion.

Thus, as has been seen, the present invention provides a dry dusting applicator capable of dispensing wax or other powders with equal efficacy. A truly universal sprayer or applicator is accordingly disclosed since such diverse materials as wax and starch can be sprayed without any change in the apparatus required. The sprayer includes a metering means which achieves a uniform profile laydown and prevents buildup on the dispensing roll.

I claim as my invention:

1. An electrostatic sprayer for dispensing relatively small size powder particles which comprises a receptacle for containing a quantity of said powder particles, said receptacle having an open bottom area through which powder particles may exit, a rotatable dispensing roll positioned within the open area and sized to pick up a certain amount of said powder as it rotates within the receptacle, at least one brush mounted adjacent the open area contacting the surface of the dispensing roll for restricting the amount of powder which can be carried by the surface of the dispensing roll through the open area of the receptacle, and electrostatic discharge means adjacent said dispensing roll and brush for creating an electrostatic field of the desired magnitude to remove powder particles from the dispensing roll after passing through the open area of the receptacle and to further prevent accumulation of particles in said brush.

2. The electrostatic sprayer of claim 1 wherein a wiping blade is provided and contacts the dispensing roll on the side of said open area opposite from said brush to seal the powder receptacle as the dispensing roll rotates within the open area of the receptacle.

3. The electrostatic sprayer of claim 1 wherein said brush is tapered having longer bristles which contact the dispensing roll and shorter bristles which support the longer bristles and oppose the flexing caused by rotation of the dispensing roll to prevent powder particles from sifting down through the receptacle.

4. The electrostatic sprayer of claim 1 wherein the discharge means comprises a first, thin, flexible high voltage wire and which includes means for holding the wire taut and uniformly spaced with respect to the dispensing roll and brush.

5. The electrostatic sprayer of claim 4 in which said first wire is positioned adjacent one side of said open area for removing substantially all of the powder carried by said dispensing roll, and a second high voltage wire is positioned adjacent an opposite side of said open area for providing an electrostatic field to remove powder particles remaining on the surface of the dispensing roll after passing the electrostatic field of said first wire.

6. The electrostatic sprayer of claim 3 wherein said brush is mounted with a free end in depending relation to the horizontal so as to be generally tangentially disposed with respect to said roll with a side portion thereof contacting said roll.

7. An electrostatic sprayer for dispensing powder particles which comprises a powder receptacle having an open bottom area, powder particles contained within the receptacle, a dispensing roll positioned within the open bottom area and sized so that a channel exists on opposite sides of said dispensing roll, said dispensing roll being rotatable to pick up a certain amount of powder on its outer surface as it rotates within the receptacle, a first brush mounted adjacent the channel on one side of said roll for contacting the surface of the dispensing roll to prevent powder from exiting the receptacle through said channel other than being carried by the surface of said roll, first electrostatic discharge means positioned adjacent said first brush for providing an electrostatic field to remove powder particles carried by the dispensing roll as it rotates through the open area and to prevent an accumulation of powder in said first brush, a second brush mounted adjacent the opposite channel for contacting the surface of the dispensing roll to prevent powder from exiting the receptacle and for further removing the powder particles on the surface of said dispensing roll after passing the electrostatic field of said first electrostatic discharge means, and second electrostatic discharge means adjacent said second brush for removing any remaining powder particles on said surface and for further preventing an accumulation of powder in said second brush.

8. The electrostatic sprayer of claim 7 wherein the dispensing roll has an engraved surface, and said first and second discharge means each comprise flexible, high voltage wire.

9. The electrostatic sprayer of claim 7 wherein said first and second brushes each are mounted with their free ends in depending relation to the horizontal so as to be generally tangentially disposed relative to said roll with said portions of each contacting said roll.

* * * * *